United States Patent [19]

Talbert, Jr.

[11] Patent Number: 4,873,846

[45] Date of Patent: Oct. 17, 1989

[54] TEXTILE STEAMING APPARATUS

[75] Inventor: James E. Talbert, Jr., Lancaster, S.C.

[73] Assignee: Morrison Textile Machinery Company, Fort Lawn, S.C.

[21] Appl. No.: 292,415

[22] Filed: Dec. 30, 1988

[51] Int. Cl.[4] ..... D06B 3/12; D06B 23/30

[52] U.S. Cl. ..... 68/5 E; 68/13 R

[58] Field of Search ..... 68/5 D, 5 E, 13 R, 62, 68/181 R, 205 R

[56] References Cited

U.S. PATENT DOCUMENTS

| | | | |
|---|---|---|---|
| 189,371 | 4/1877 | Mather . | |
| 2,089,920 | 8/1937 | Aubauer . | |
| 3,950,802 | 4/1976 | Schiffer et al. | 68/5 D X |
| 4,004,879 | 1/1977 | Meier-Windhorst et al. | 68/5 D X |
| 4,102,157 | 7/1978 | Schuierer | 68/5 D |
| 4,150,449 | 4/1979 | Talbert | 62/62 X |
| 4,182,140 | 1/1980 | Sando et al. | 68/5 E |
| 4,182,142 | 1/1980 | Sando et al. | 68/5 E |
| 4,275,575 | 6/1981 | Schiffer | 68/5 E |
| 4,642,164 | 2/1987 | Hanhikoski et al. | 68/5 D X |
| 4,711,102 | 12/1987 | Sando et al. | 68/5 E |

OTHER PUBLICATIONS

"Application Engineering Data", AED 220-173, Aug. 1972, 3 pages, The Foxboro Company.

*Primary Examiner*—Philip R. Coe

*Attorney, Agent, or Firm*—Bell, Seltzer, Park & Gibson

[57] ABSTRACT

A textile steamer is disclosed which is adapted for use in association with a continuous dyeing, scouring, bleaching, or other textile processing operation. The steamer includes at least two vertical rows of fabric guide rollers such that the fabric may be threaded onto the rollers along generally horizontal runs. In addition, a water spray system is provided which is designed to avoid the necessity of having an operator enter the steamer to effect cleaning, and which also avoids the risk of having condensed water dripping from the water spray system onto the runs of the fabric. The water spray system includes vertical rows of water delivery pipes positioned parallel to and laterally outside of the rows of fabric guide rollers, and each of the pipes includes a plurality of nozzles for directing a water spray onto the full length of the adjacent guide rollers. Since the water pipes and nozzles are positioned laterally outside of the guide rollers, there is no risk of water dripping from the pipes or nozzles onto the runs of fabric.

19 Claims, 3 Drawing Sheets

TEXTILE STEAMING APPARATUS

BACKGROUND OF THE INVENTION

The present invention relates to a textile steamer for steaming a continuously advancing fabric, and having provision for the rapid wash down of the interior components of the steamer between fabric steaming operations.

In many textile fabric processing operations, such as dyeing, scouring, or bleaching, it is conventional to continuously advance a fabric web through a steam chamber in order to treat the fabric. For example, in continuous open width dyeing, the steaming operation is required in order to complete the reduction of the dyestuff and to cause the dye to fix onto the fabric. Prior textile steamers of the described type are typically composed of a plurality of guide rollers arranged in two horizontal rows, and so that the fabric is threaded among the rollers in vertical runs.

As will be apparent, the guide rollers of the steamer become contaminated with the particular dye or other chemicals which have been applied to the fabric, and it is thus necessary to clean the guide rollers between production operations. Such cleaning is presently conducted by an operator entering into the chamber through a side door, and then manually cleaning the rollers with a hose while standing or sitting on the lower row of rollers. This is an uncomfortable and labor intensive operation. It has not been considered feasible to add water spray nozzles adjacent the rollers, since the pipes and nozzles tend to collect condensate and drip onto the fabric during normal operation, resulting in permanent water spots on the fabric.

It is accordingly an object of the present invention to provide a textile steamer of the described type, and wherein the steamer incorporates an internal system for providing the rapid wash down of the interior components of the steamer between fabric steaming operations, and which avoids the disadvantages and limitations of the present cleaning processes as described above.

It is a more particular object of the present invention to provide a textile steamer of the described type, and wherein the steamer incorporates an internal water cleaning system for permitting the wash down of the guide rollers between fabric steaming operations, and which avoids the risk of water dripping from the cleaning system onto the fabric during normal operation.

It is still another object of the present invention to provide a textile steamer which avoids the necessity of having an operator enter the steamer chamber to effect cleaning, but which is designed to permit the operator to readily enter the steamer if desired for periodic inspection or repair as may be required.

SUMMARY OF THE PRESENT INVENTION

These and other objects and advantages of the present invention are achieved in the embodiments illustrated herein by the provision of a textile steamer which comprises an enclosed chamber, and means for introducing steam into the chamber. At least two vertical rows of fabric guide rollers are mounted in the housing, and with the rollers being disposed along parallel horizontal axes and such that a fabric may be threaded onto the rollers in a sinusoidal path to define generally horizontal runs of the fabric between the rollers.

Water spray means is mounted within the chamber for directing a water spray onto the full length of each of the rollers to permit the rollers to be cleaned between fabric steaming operations. The water spray means comprises at least two vertical rows of water delivery pipes positioned parallel to and laterally outside of respective ones of the vertical rows of rollers, and nozzle means mounted on each of the pipes for directing the water spray onto the full length of at least one adjacent roller. Thus any water dripping from the water delivery pipes or nozzle means during normal operation of the steamer will not fall upon the horizontal runs of fabric.

In the preferred embodiment, the chamber includes four peripheral side walls, including first and second peripheral side walls disposed generally parallel to the axes of the guide rollers, and third and fourth opposite side walls disposed at right angles to the first and second side walls. Also, at least one of the third and fourth side walls includes a door positioned between the two rows of guide rollers, for permitting access into the interior of the chamber by an operator. Further, the first side wall includes a fabric entry slot for admitting the advancing fabric, and the second opposite side wall includes a fabric outlet slot for permitting the advancing fabric to exit from the chamber.

BRIEF DESCRIPTION OF THE DRAWINGS

Some of the objects and advantages of the present invention having been states, others will appear as the description proceeds, when taken in conjunction with the accompanying drawings, in which.

DETAILED DESCRIPTION OF THE PREFERRED EMBODIMENT

Figure 1:
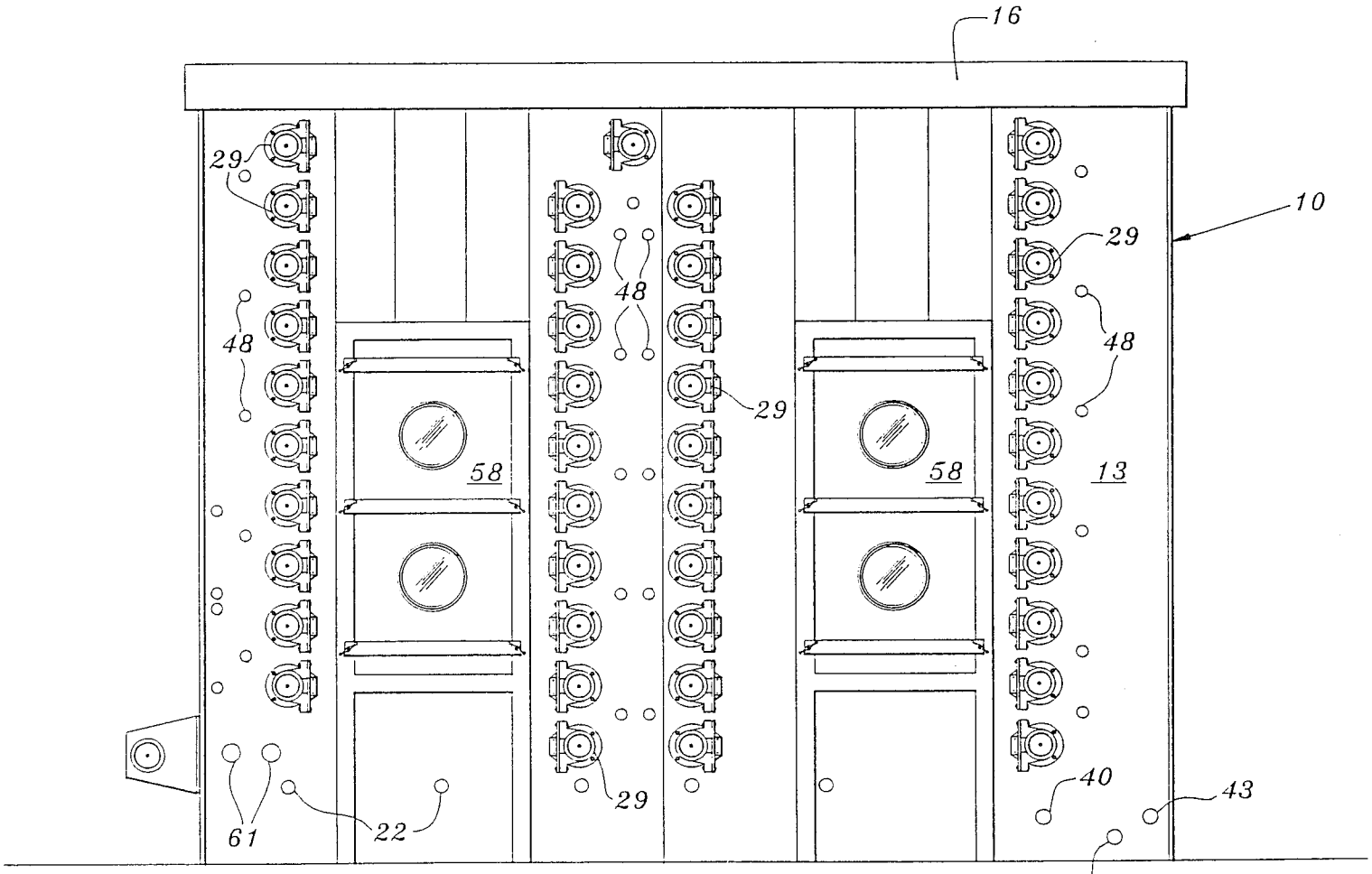
FIG. 1 is a front elevation view of an apparatus embodying the features of the present invention.

The embodiment of the present invention specifically illustrated in the drawings comprises a textile steamer which comprises an enclosed chamber 10 including four peripheral side walls, namely first and seocnd opposite side walls 11, 12, and third and fourth opposite side walls 13, 14 which are disposed at right angles to the first and second walls. Also, the steamer includes a removable cover 16 which is positioned on the top of the four side walls.

Figure 5:
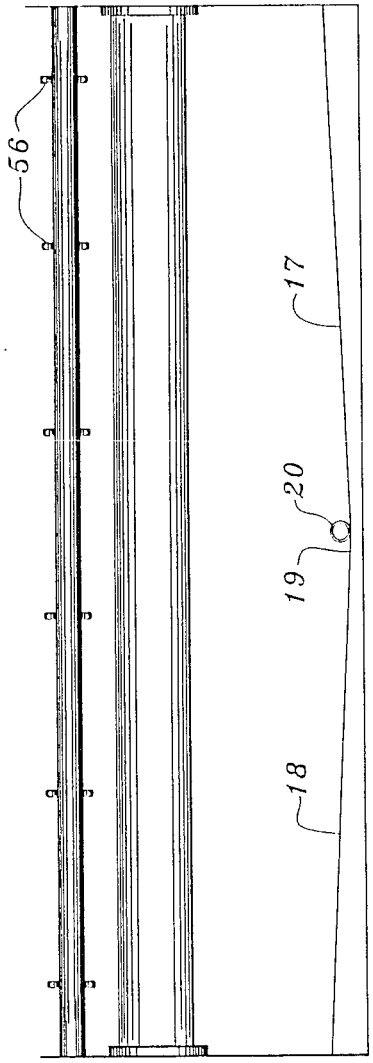
FIG. 5 is a fragmentary side elevation view taken substantially along the line 5—5 of FIG. 2.

The bottom wall or floor of the steamer is composed of two inclined sections 17, 18 as best seen in FIG. 5, and which define a shallow V-shaped lower trough 19 along the middle of the chamber and which extends between the first and second walls 11, 12. Also, the first wall 11 includes a drain outlet fitting 20 which is aligned with the lower trough 19 for permitting the chamber to be drained of any water.

In the illustrated embodiment, five steam injection pipes 22 extend laterally across the chamber adjacent the bottom wall, and a cover 23 is positioned above each of the pipes 22 for preventing the steam from directly contacting the advancing fabric F.

A fabric entry slot 25 is positioned in the side wall 11 for admitting the advancing fabric F into the interior of the chamber, with the slot being positioned at an elevation immediately above the elevation of the steam injection pipes 22 and cover 23. Further, a fabric outlet slot 26 is positioned in the opposite side wall 12 for permitting the advancing fabric to exit from the chamber at an elevation generally corresponding to that of the entry slot.

The steamer of the illustrated embodiment further includes four vertical rows of fabric guide rollers 28, which are mounted in the chamber, and which extend between the side walls 13,14. The rollers 28 are disposed along parallel horizontal axes, and the rollers 28 are rotatably mounted to each of the side walls 13 and 14 by means of externally positioned bearings 29, which receive a shaft mounted on each end of each roller.

The first row 31 of rollers is positioned adjacent the side wall 11, and such that the axes of the rollers are parallel to the plane defined by the wall 11. The second row 32 of rollers is positioned on the side of the first row opposite the side wall 11, the third row 33 is positioned on the side of the second row opposite the side wall 11, and the fourth row 34 is positioned on the side of the third row opposite the side wall 11, and such that the fourth row 34 is positioned adjacent the opposite side wall 12. The fabric entry slot 25 and the fabric outlet slot 26 are positioned at an elevation adjacent the bottom of the rows 31–34 of guide rollers.

Figure 2:
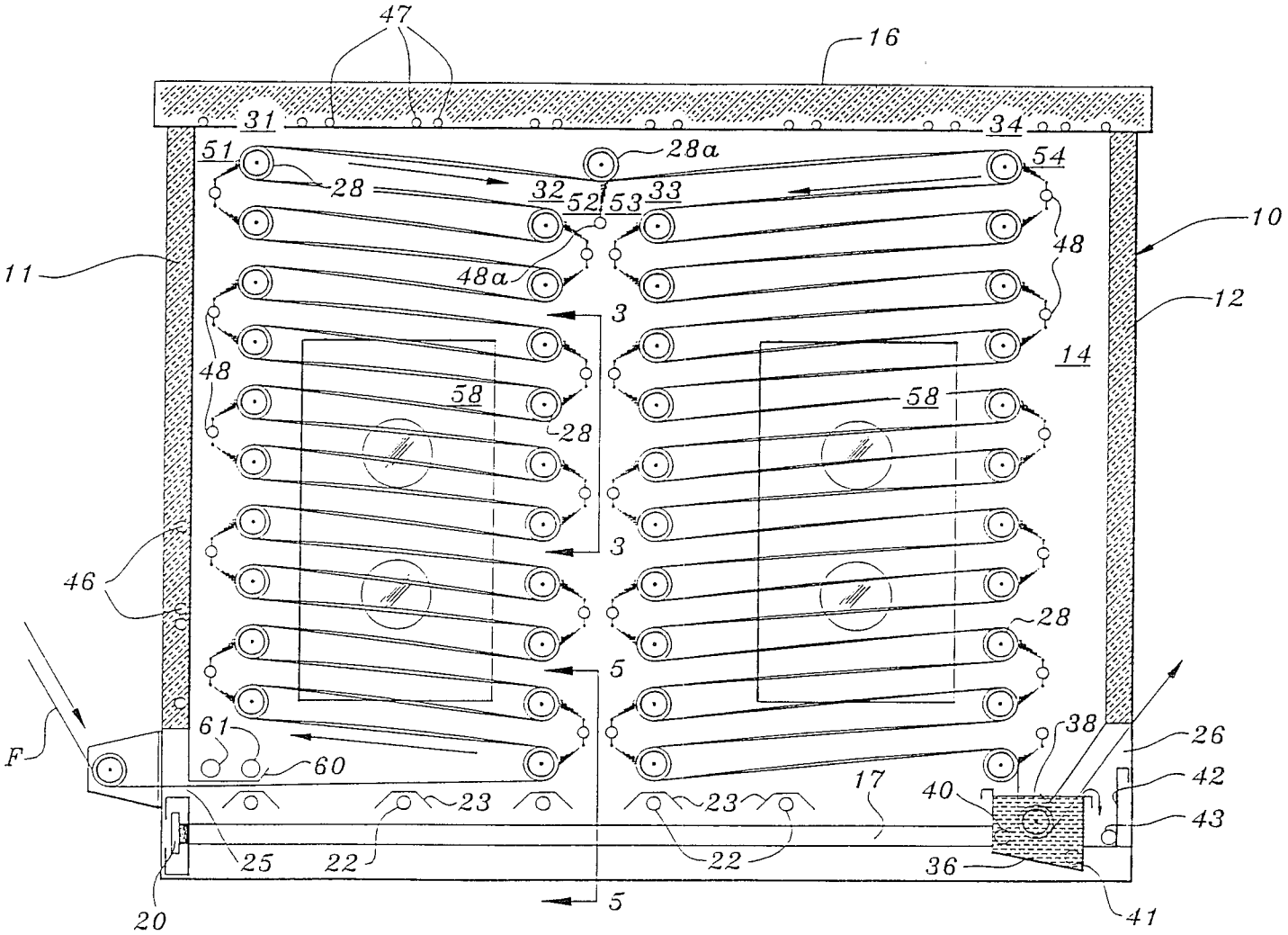
FIG. 2 is a sectional front elevation view showing the internal components of the apparatus shown in FIG. 1.

As best seen in FIG. 2, the fabric F is advanced into the chamber 10 through the entry slot 25, and is then directed horizontally to the lowermost roller of the row 32 to define an entering fabric run. The fabric F is threaded about the rollers of the first and second rows of rollers so as to move upwardly in a generally sinusoidal path to define generally horizontal runs of the fabric between the rollers and it is then threaded onto the rollers of the third and fourth rows so as to move downwardly in a similar sinusoidal path to define generally horizontal runs of fabric between those rollers.

An additional fabric guide roller **28*a* is positioned between and above the second and third rows 32, 33 of rollers for guiding the advancing fabric from the uppermost one of the rollers in the first row 31 to the uppermost one of rollers in the fourth row 34**. Thus the fabric advancing upwardly in the runs between the first and second rows is transferred generally horizontally along the top of the chamber to the third and fourth rows and such that they advance downwardly in the runs between such rollers.

A water trough 36 is positioned immediately below the fourth row 34 of rollers and adjacent the outlet slot 26, and a guide roller 38 is positioned within the water trough for guiding the advancing fabric from the lowermost roller 28 of the fourth row 34 into the water trough and then outwardly through the outlet slot 26. The water trough 36 includes an inlet pipe 40 for supplying water to the trough, and a drain line 41. Also, an adjacent overflow trough 42 is positioned adjacent the water trough 36, and the overflow trough 42 includes a drain line 43. Thus water may be continuously circulated into the water trough 36, and so that it spills into the overflow trough 42, and is then removed from the overflow trough by the drain line 43.

The first and second opposite walls 11, 12 of the steamer are composed of inner and oauter sheet metal layers, with an insulating material disposed between the layers. Also, the lower portion of the first wall 11 includes internal heating pipes 46 which are connected to a source of steam or the like, and by which the internal sheet metal layer of the wall may be heated. The cover 16 is similarly constructed of inner and outer layers of sheet metal, with an insulating material between the metal layers. In addition, the cover 16 includes similar pipes 47 for admitting a heating fluid such as steam, and so that the temperature of the lower sheet metal layer of the cover may be heated. This heating means in the first wall 11 and the cover 16 serves to flash off any condensed water, to thereby prevent dripping of such condensate onto the advancing fabric.

Figure 4:
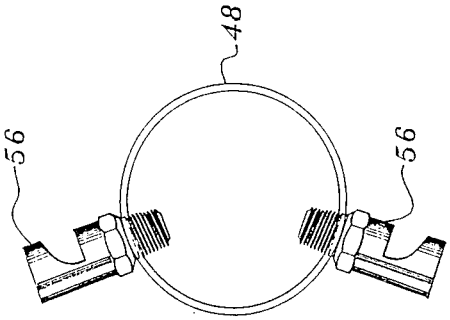
FIG. 4 is an enlarged sectional view of one of the water spray pipes and associated nozzles of the present invention, and taken substantially along the line 4—4 of FIG. 3.
Figure 3:
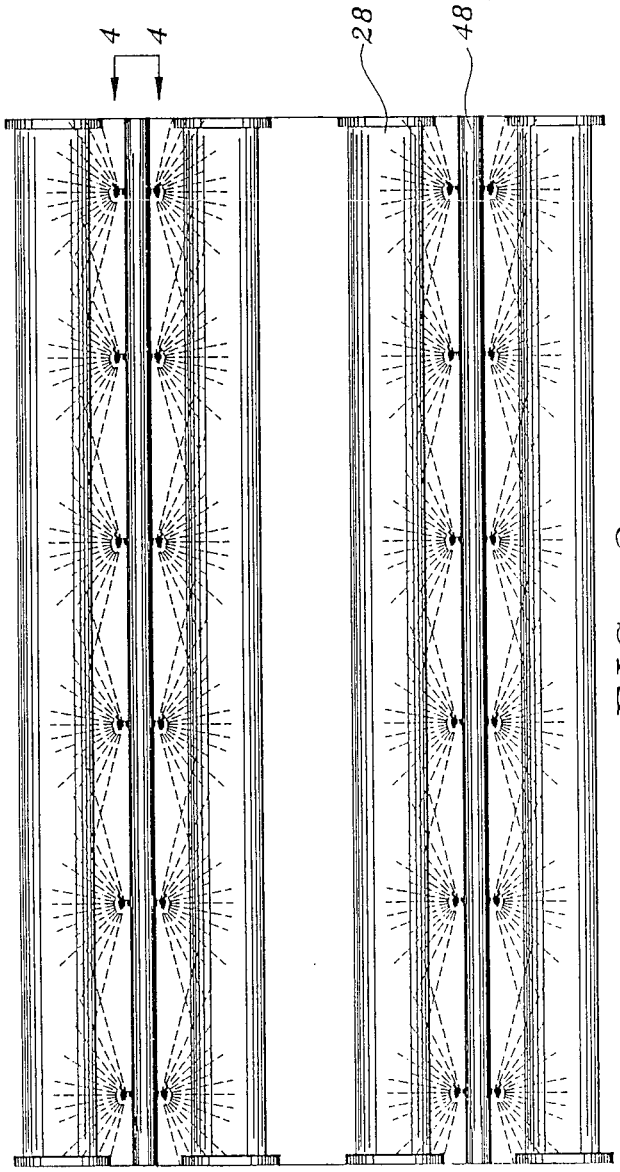
FIG. 3 is a fragmentary side elevation view of the guide rollers and water spray means of the present invention, and taken substantially along the line 3—3 of FIG. 2.

The steamer of the present invention also includes water spray means mounted within the chamber for directing a water spray onto the full length of each of the guide rollers 28, to thereby permit the guide rollers 28 to be cleaned between fabric steaming operations. This water spray means comprises a vertical row of water delivery pipes 48 associated with each of the rows of guide rollers. More particularly, the rows of water pipes are positioned parallel to and laterally outside of the respective ones of the vertical rows of guide rollers, and they include a first row 51 of water pipes positioned between the side wall 11 and the first row 31 of rollers, second and third rows 52, 53 of water pipes positioned between the second and third rows 32, 33 of rollers, and a fourth row 54 of water pipes positioned between the fourth row 34 of rollers and the opposite side wall 12. In addition, a plurality of nozzles 56 are mounted on each of the pipes 48 in spaced relation along the length thereof, for directing a water spray onto the full length of at least one adjacent roller. In the preferred embodiment, and as best seen in FIGS. 3–5, all of the pipes 48 except for the lowermost pipe in the fourth row 34, mount two horizontal rows of spaced apart nozzles 56, with the nozzles of each row being oriented so as to direct the water spray onto an adjacent roller. Thus each of these water pipes serves to supply a water spray onto two adjacent rollers. The water nozzles 56 are of conventional design, and are adapted to direct a water spray in a fan-like pattern as best seen in FIG. 3, and with the sprays of adjacent nozzles overlapping somewhat on each guide roller.

The water spray means further includes a pipe **48*a* positioned below and parallel to the roller 28*a*, and which has a single row of nozzles 56 for spraying the guide roller 28*a*. The lowermost pipe 48 in the row 54 similarly has a single row of nozzles 56**.

The third and fourth side walls 13, 14 of the steamer each mount a pair of removable doors 58 positioned respectively between the first and second rows of guide rollers, and between the third and fourth rows of guide rollers. These removable doors 58 provide ready access into the interior of the chamber by an operator to permit periodic inspection or repair as may be required.

The steamer also includes a drip tray 60 disposed below the first row 51 of water delivery pipes, and above the initial fabric run which is defined between the fabric entry slot 25 and the lowermost guide roller of the second row 32. The drip tray 60 is designed to catch any condensed water dripping from the first row 51 of water delivery pipes and thus prevent contact with the initial fabric run. Further, a pair of heating pipes 61 which may be connected to a steam source, extend along the length of the drip tray to flash off any water received thereon.

From the above, it will be seen that the arrangement of the water delivery pipes 48 at a location laterally outside of the first and second rows 31, 32 of guide rollers, serves to ensure that any water dripping from the pipes or nozzles of these rows during normal operation of the steamer will not fall upon the horizontal runs of fabric defined by the first and second rows 31, 32 of guide rollers. In addition, the water delivery pipes 48 of the third and fourth rows 33, 34 of guide rollers are located outside of such rows, and similarly serve to ensure that water will not fall upon the horizontal runs of fabric defined by the third and fourth rows of rollers. Also, the additional water pipe 48*a* and nozzles for the roller 28*a* are positioned such that any water dripping from such pipe will fall between the second and third rows of rollers and will not fall upon any of the runs of the fabric.

It should be noted that the runs of the fabric defined between the first and second rows 31, 32 of rollers, and between the third and fourth rows 33, 34 of rollers, are inclined a few degrees from the horizontal. This arrangement is preferable to avoid a bowing or "hammock effect" caused by the weight of the water laden fabric and which could distort the fabric during treatment. The slight incline permits the water to run along the fabric and thus relieve the distorting force.

As noted above, the guide rollers 28 of the steamer are preferably rotatably mounted by means of bearings 29 which are attached to the outside of the third and fourth walls 13, 14 as best seen in FIG. 1. In most applications, it is unnecessarily to positively drive the rollers 28, but in instances where such positive driving is desired, this may be easily effected by extending the mounting shaft on one end of each roller and attaching drive sprockets to each of the mounting shafts of the rollers. Drive chains may then be disposed about the sprockets in a conventional manner to concurrently drive all of the guide rollers 28.

Various procedures may be employed for effecting the cleaning of the guide rollers 28 with the above described steamer. For example, a leader fabric having the same width as the fabric being processed may be sewn onto the end of the fabric being processed. The leader fabric may then be immersed in a cleaning solution and run through the steamer to saturate all of the rollers. Hot water may then be sprayed from the nozzles to rinse off the cleaning solution as well as the contaminating chemicals, and with the water being removed through the drain 20. Alternatively, a cleaning solution could be ejected directly from the nozzles 56 onto the guide rollers 28.

As will be understood, the cleaning operation tends to cool the steamer. To facilitate reheating, the water delivery pipes 48 may be connected via a suitable valve to a steam line, and so that steam may be directly ejected from the nozzles 56 prior to commencement of the steaming operation.

In the drawings and specification, there has been set forth a preferred embodiment of the invention, and although specific terms are employed, they are used in a generic and descriptive sense only and not for purposes of limitation. For example, while the illustrated steamer includes four vertical rows of guide rollers, it will be understood that steamers having two, six, or any even number of vertical rows of rollers could be employed. Also, the steamer of the present invention could be utilized in combination with other conventional steamers having vertical runs of fabric, or a perforated conveyor belt or roller drive.

That which is claimed is:

1. A textile steamer for steaming a continuously advancing fabric and having provision for the rapid wash down of the interior components of the steamer between fabric steaming operations, said steaming comprising an enclosed chamber, means for introducing steam into said chamber, at least two vertical rows of fabric guide rollers mounted in said housing, and with the rollers being disposed along parallel horizontal axes and such that a fabric may be threaded onto the rollers in a sinusoidal path to define generally horizontal runs of the fabric between the rollers, and water spray means mounted within said chamber for directing a water spray onto the full length of each of said rollers to permit the rollers to be cleaned between fabric steaming operations, said water spray means comprising at least two vertical rows of water delivery pipes positioned parallel to and laterally outside of respective ones of said vertical rows of rollers, and nozzle means mounted on each of said pipes for directing the water spray onto the full length of at least one adjacent roller, and wherein any water dripping from the water delivery pipes or nozzle means during normal operation of the steamer will not fall upon said horizontal runs of fabric.

2. The textile steamer as defined in claim 1 wherein said chamber includes first and second peripheral side walls disposed generally parallel to the axes of said guide rollers, and third and fourth opposite side walls at right angles to said first and second walls, and wherein at least one of said third and fourth side walls includes a door positioned between said two rows of guide rollers for permitting access into the interior of the chamber by an operator.

3. The textile steamer as defined in claim 1 wherein said means for introducing steam into said chamber comprises a plurality of steam injection pipes positioned below said rows of fabric guide rollers and below said rows of water delivery pipes.

4. The textile steamer as defined in claim 1 wherein said chamber includes four peripheral side walls, a fabric entry slot in one side wall for admitting the advancing fabric, and a fabric outlet slot in the opposite side wall for permitting the advancing fabric to exit from said chamber, and wherein said rows of fabric guide rollers include a first row adjacent said one side wall and a second row located on the side of said first row opposite said one side wall.

5. The textile steamer as defined in claim 4 further comprising a water trough positioned adjacent said outlet slot, guide roller means for guiding the advancing fabric into said water trough, and panel means extending from said opposite side wall into said trough to provide an air seal at said outlet slot.

6. The textile steamer as defined in claim 5 wherein said fabric entry slot is positioned at an elevation adjacent the bottom of said rows of guide rollers and so that the entering fabric forms an initial generally horizontal run which extends below said first vertical row of guide rollers, and then to the lowermost one of the guide rollers of said second row.

7. The textile steamer as defined in claim 6 wherein said rows of water delivery pipes include a first row of water delivery pipes positioned between said one side wall and said first row of guide rollers, and a second row of water delivery pipes positioned on the side of said second row of rollers opposite said one side wall.

8. The textile steamer as defined in claim 7 further comprising a drip tray disposed below said first row of water delivery pipes and above said initial fabric run, and so that the drip tray catches any water dripping from said first row of water delivery pipes.

9. The textile steamer as defined in claim 8 further comprising means for heating said drip tray to flash off any water received thereon.

10. The textile steamer as defined in claim 1 wherein at least some of said water delivery pipes in each of said two rows of pipes are positioned at an elevation between the elevations of two adjacent rollers, and each of said some pipes includes a pair of nozzle means which are oriented to spray water upon respective ones of the two adjacent rollers.

11. The textile steamer as defined in claim 1 wherein said chamber includes four peripheral side walls and an overlying cover, and one of said side walls includes a fabric entry slot for admitting an advancing fabric, and further comprising means for heating said one side wall and said cover to flash off any condensed water and thereby avoid having water drip from said one side wall and cover onto the fabric being treated in said chamber.

12. The textile steamer as defined in claim 11 wherein said side wall opposite said one side wall includes a fabric outlet slot for permitting the advancing fabric to exit from said chamber, and further comprising a water trough positioned adjacent said outlet slot, and guide roller means for guiding the advancing fabric into said water trough prior to advancing through said outlet slot.

13. The textile steamer as defined in claim 12 wherein said opposite side wall mounts a deflector panel which extends from said opposite side wall into said water trough to provide an air seal at said outlet slot and to cause any condensed water formed on said opposite side wall to run down said deflector panel and into said trough.

14. A textile steamer for steaming a continuously advancing fabric and having provision for the rapid wash down of the interior components of the steamer between fabric steaming operations, said steamer comprising an enclosed chamber including four peripheral side walls, a fabric entry slot in one side wall for admitting the advancing fabric, and a fabric outlet slot in the opposite side wall for permitting the advancing fabric to exit from said chamber, means for introducing steam into said chamber, at least four vertical rows of fabric guide rollers mounted in said housing, and including a first row positioned adjacent said one side wall, a second row positioned on the side of said first row opposite said one side wall, a third row positioned on the side of said second row opposite said one side wall, and a fourth row positioned on the side of said third row opposite said one side wall, and such that said fourth row is positioned adjacent said opposite side wall, and with the rollers being disposed along parallel horizontal axes and such that a fabric may be threaded onto the rollers of said first and second rows of rollers in a sinusoidal path to define generally horizontal runs of the fabric between the rollers, and then threaded onto the rollers of said third and fourth rows of rollers in a sinusoidal path to define generally horizontal runs of the fabric between the rollers, and water spray means mounted within said chamber for directing a water spray onto the full length of each of said rollers to permit the rollers to be cleaned between fabric steaming operations, said water spray means comprising at least four vertical rows of water delivery pipes positioned parallel to and laterally outside of respective ones of said vertical rows of rollers, and nozzle means mounted on each of said pipes for directing the water spray onto the full length of at least one adjacent roller, and wherein any water dripping from the water delivery pipes or nozzle means during normal operation of the steamer will not fall upon said horizontal runs of fabric.

15. The textile steamer as defined in claim 14 wherein a first vertical row of water pipes is positioned between said one side wall and said first row of rollers, second and third rows of water pipes are positioned between said second and third rows of rollers, and a fourth row of water pipes is positioned between said fourth row of rollers and said opposite side wall.

16. The textile steamer as defined in claim 15 wherein said means for introducing steam into said chamber comprises a plurality of steam injection pipes positioned below said rows of fabric guide rollers and below said rows of water delivery pipes, and wherein said fabric entry slot is positioned at an elevation adjacent the bottom of said rows of guide rollers and so that the entering fabric forms an initial generally horizontal run which extends below said first row of rollers and then to the lowermost one of the guide rollers of said second row.

17. The textile steamer as defined in claim 16 further comprising a fabric outlet slot in said opposite side wall at an elevation adjacent the bottom of said rows of guide rollers for permitting the advancing fabric to exit the chamber, a water trough positioned adjacent said outlet slot, panel means extending from said opposite side wall into said trough to provide an air seal at said outlet slot, and guide roller means for guiding the fabric into said water trough prior to leaving said container.

18. The textile steamer as defined in claim 17 further comprising an additional fabric guide roller positioned between and above said second and third rows of rollers for guiding the advancing fabric from the uppermost one of the rollers in said first row of rollers to the uppermost one of the rollers in said fourth row of rollers, and whereby the fabric advances upwardly in the runs between said first and second rollers and downwardly in the runs between said third and fourth rollers.

19. The textile steamer as defined in claim 18 wherein said water spray means comprises a further water delivery pipe positioned adjacent and below said further guide roller, and further nozzle means mounted on said further pipe for directing a water spray onto the full length of said further roller.

* * * * *